US007652221B2

(12) United States Patent
Lohrberg et al.

(10) Patent No.: US 7,652,221 B2
(45) Date of Patent: Jan. 26, 2010

(54) CONTACT DRIVE ARRANGEMENT

(75) Inventors: Henrik Lohrberg, Frankfurt am Main (DE); Joachim Eggers, Hanau a. M. (DE)

(73) Assignee: ABB Technology AG, Zurich (CH)

( * ) Notice: Subject to any disclaimer, the term of this patent is extended or adjusted under 35 U.S.C. 154(b) by 68 days.

(21) Appl. No.: 11/950,684

(22) Filed: Dec. 5, 2007

(65) Prior Publication Data

US 2009/0020508 A1 Jan. 22, 2009

(30) Foreign Application Priority Data

Dec. 7, 2006 (DE) ..... 10 2006 058 042

(51) Int. Cl.
*H01H 3/00* (2006.01)
*H01H 33/34* (2006.01)

(52) U.S. Cl. ..... 218/154; 218/93; 218/94; 218/126

(58) Field of Classification Search ..... 218/8–21, 218/45, 78, 80, 92, 93, 94, 126
See application file for complete search history.

(56) References Cited

U.S. PATENT DOCUMENTS 5,170,023 A * 12/1992 Pham et al. ..... 218/143
5,296,662 A * 3/1994 Engdahl et al. ..... 218/93
5,354,959 A * 10/1994 Yoshizumi et al. ..... 218/84

* cited by examiner

*Primary Examiner*—Ramon M Barrera
(74) *Attorney, Agent, or Firm*—Buchanan Ingersoll & Rooney PC

(57) ABSTRACT

The disclosure relates to a contact drive arrangement for the movement of at least one contact in high-voltage switchgear systems having a contact drive and having an auxiliary switch, which has at least two auxiliary contacts. The contact drive works together with the at least one contact and with a first auxiliary contact. Furthermore, a delay drive is connected functionally in parallel with the contact drive, and the delay drive works together with a second auxiliary contact. The first and second auxiliary contact are electrically connected in series. In addition, the delay drive has a damping element, and by means of the damping element the time for a switching operation is extended in comparison with the time for a switching operation with the contact drive.

18 Claims, 2 Drawing Sheets

CONTACT DRIVE ARRANGEMENT

RELATED APPLICATIONS

This application claims priority under 35 U.S.C. §119 to German Patent Application No. 10 2006 058 042.7 filed in the German Patent Office on 7 Dec. 2006, the entire contents of which are hereby incorporated by reference in their entireties.

TECHNICAL FIELD

A contact drive arrangement for the movement of at least one contact in high-voltage switchgear systems is disclosed.

BACKGROUND INFORMATION

High-voltage switchgear systems, in particular gas-insulated high-voltage switchgear systems (GIS) are generally known and have been used for many years in the voltage range of about 7.2 kV to 800 kV. GIS systems are usually designed using modular techniques. System components such as busbars, isolating switches, circuit breakers, transducers, if necessary with cable sealing boxes and connecting elements, are in this case arranged as gas-tight encapsulated modules. Sulphur hexafluoride ($SF_6$) is normally used as the insulating gas, but other gases are also used.

In such high-voltage switchgear systems, drives, which move electrical contacts, for example, in isolators, switches etc, are necessary in order to guarantee the proper operation of such a system. For this purpose, hydromechanical drives are used amongst others in order to carry out the movement of electrical contacts for different switching sequences. One of these switching sequences is so-called CO switching, which includes a closing with a subsequent re-opening of a switch. On the drive side, this switching sequence is brought about by an auxiliary switch, which normally has several contacts, which close or open depending on a drive position of the switch. In CO switching, the signal for the opening signal is already given when the switch closes; however the appropriate circuit remains interrupted due to the auxiliary switch until the drive has almost reached the closed position. However, for some switchgear systems, the time needed for the switching sequence by the drive controlled in this way is so small that the closed position is never reached and is overlaid by the opening operation in such a way that, all in all, the switch does not close properly.

SUMMARY

A contact drive arrangement is disclosed, which ensures that certain switching sequences, e.g., CO switching, can be carried out properly. Such a contact drive arrangement can achieve movement of at least one contact in high-voltage switchgear systems of the type mentioned in the introduction.

A contact drive arrangement is disclosed for the movement of at least one contact in high-voltage switchgear systems having a contact drive and having an auxiliary switch, which has at least two auxiliary contacts, the contact drive working together with the at least one contact and with a first auxiliary contact. A delay drive is connected functionally in parallel with the contact drive. The delay drive works together with a second auxiliary contact. The first and second auxiliary contact are electrically connected in series, that the delay drive has a damping element. By means of the damping element the time for a switching operation is extended in comparison with the time for a switching operation with the contact drive.

The disclosure and exemplary embodiments of the invention will be explained in more detail and its advantages described with reference to the exemplary embodiments of the invention shown in the drawings.

DETAILED DESCRIPTION

The contact drive arrangement according to the disclosure of the type mentioned in the introduction is characterized in that a delay drive is connected functionally in parallel with the contact drive, that the delay drive works together with a second auxiliary contact, that the first and second auxiliary contact are electrically connected in series, that the delay drive has a damping element, and that by means of the damping element the time for a switching operation is extended in comparison with the time for a switching operation with the contact drive.

Due to the connection of a delay drive in parallel with the contact drive, a delay to the switching processes can be achieved without having to directly intervene with the contact drive itself. An example of such a direct intervention in the speed of the switching operations of the contact would be an appropriate electrical or electronic actuation, which is often not acceptable however for safety reasons. A parallel connection of the delay drive avoids a direct intervention of this kind and, at the same time, by means of the damping element, provides a particularly easy facility for setting the time until both auxiliary contacts are closed to a pre-specified value. With a switching operation delayed in this way, any required switching sequence can be realised without any problems.

The delay drive can be designed as an electrical or a pneumatic drive. The contact drive can be a hydromechanical drive.

As a rule, the contact drive itself is also a hydromechanical drive so that the retrospective installation of a delay drive or the planning of a contact drive arrangement in the manner according to the invention is particularly easy.

The existing hydraulic systems for the contact drive can then also be used for the delay drive in a particularly easy manner.

An especially compact embodiment of the subject matter of the disclosure is achieved by the use of a differential piston cylinder as the hydraulic drive.

A hydraulic delay drive can also include a hydraulic damping element, which is characterized in that the hydraulic damping element has a pre-specified quantity of a liquid damping medium in a pre-specified damping volume, said quantity being independent of the control medium, that an orifice divides the pre-specified volume, and that when activated the damping medium passes via the orifice from one part to another part of the damping volume.

In this way, a control medium is not required for the damping function of the delay drive, but only for its actuation.

Figure 1:
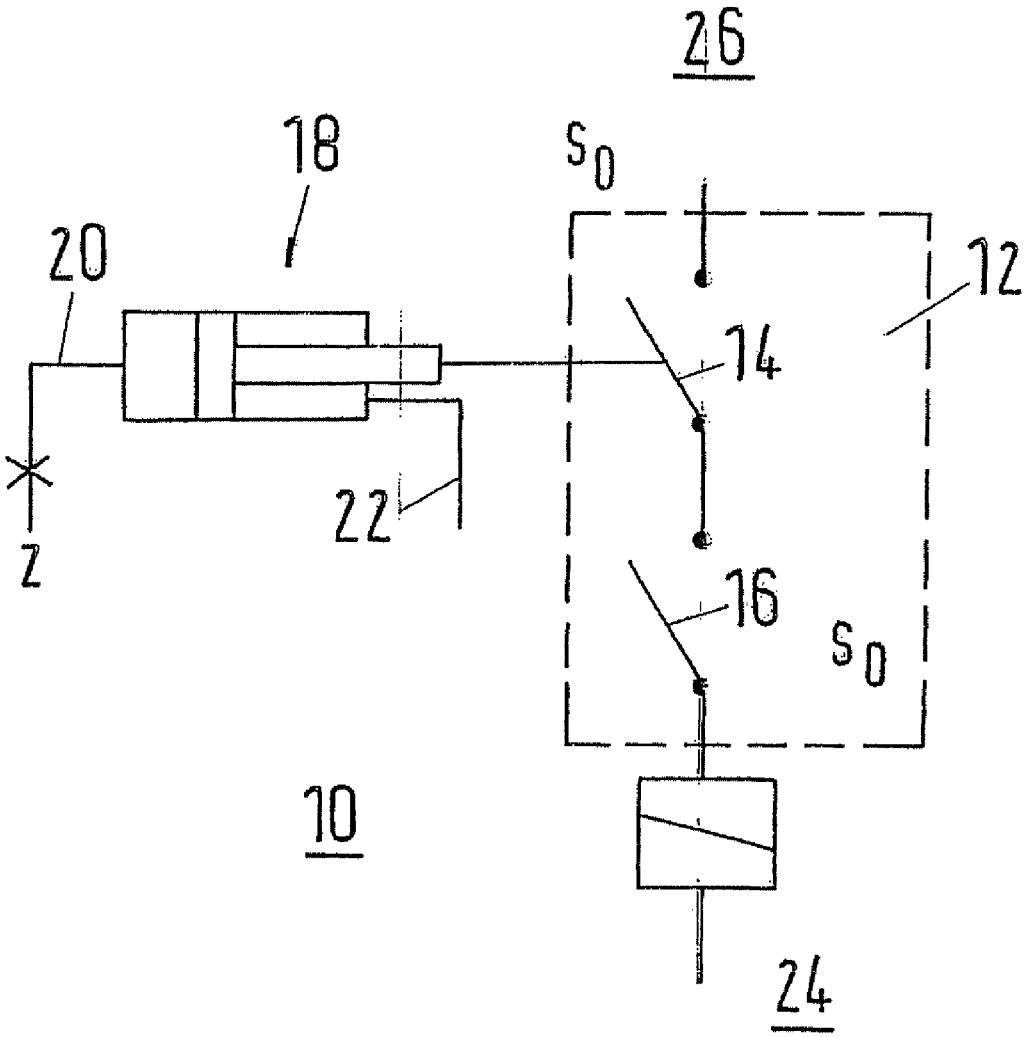
FIG. 1: shows an outline sketch of a delay circuit.

FIG. 1 shows a circuit diagram 10 with an auxiliary switch 12, which has a first auxiliary contact 14 and a second auxiliary contact 16. A contact drive 18 is also shown, which on the one hand is connected to the first auxiliary contact 14 and, on the other, drives an electrical contact of a high-voltage switch, which however is not shown in this figure. In the example shown, the contact drive 18 is a hydromechanical drive, which is represented by the cylinder-piston arrangement as a symbol for the contact drive 18. At the same time, the contact drive 18 is supplied with control medium Z by means of a control pressure line 20, while the control medium Z, e.g., a control oil, flows back via a drainage line 22 into a control medium circulation system, which is not shown in more detail here.

FIG. 1 shows both auxiliary contacts 14, 16 in the open position. If the contact drive 18 is now actuated, for example, so that it closes, the connection between the contact drive 18 and the first auxiliary contact 14 ensures that this is also closed. Notwithstanding this, the second auxiliary contact 16 is still open so that a signal flow from a signal generating side 24 to a signal receiving side 26 on the auxiliary switch 12 is not yet guaranteed. The second auxiliary contact 16 is namely actuated separately, for example electrically or pneumatically, so that this can be closed independently of the contact drive 18. This occurs by means of a damping element, which can be electric, pneumatic or also hydraulic, for example. The more detailed embodiment is not yet shown in this figure.

Figure 2:
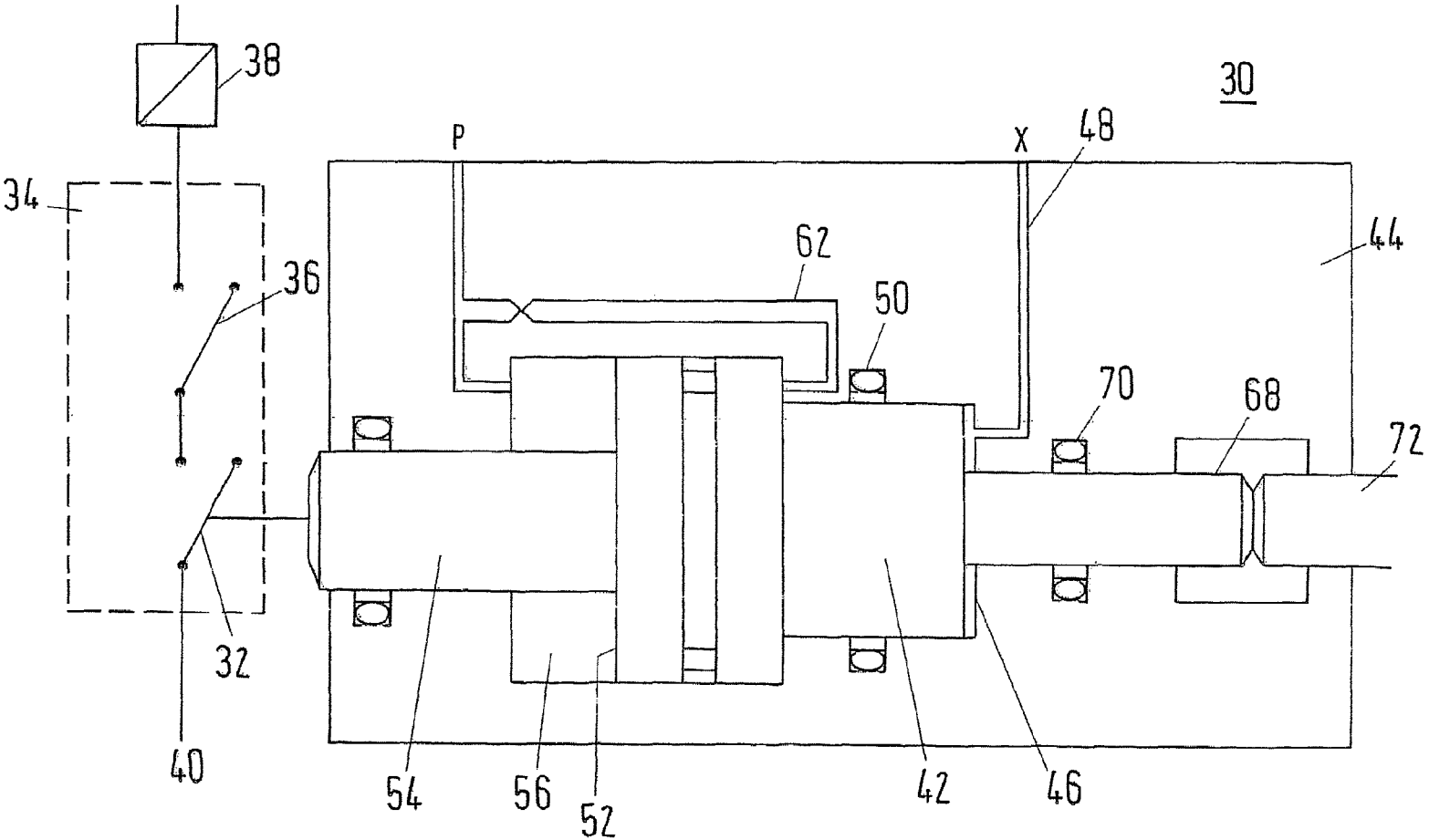
FIG. 2: shows a schematic representation of a contact drive arrangement.

FIG. 2 shows a schematic view of a delay drive 30, which is designed as a hydraulic drive and acts on a delay contact 32 of a second auxiliary switch 34. In the second auxiliary switch 34, an auxiliary switch contact 36 is also shown, which is actuated by a hydraulic contact drive, which is not shown in more detail in this figure however. In the chosen example, a signal is brought to the second auxiliary switch 34 by means of a trip coil 38. The signal will only arrive at an output side 40 of the second auxiliary switch 34 however when both the auxiliary switch contact 36 and the delay contact 32 have been brought into a closed position. Both contacts 32, 36 are shown in the open position in the figure.

The delay drive 30 has a piston 42, which is guided in a housing 44. In the chosen example, the piston 42 is designed in the form of a cylinder and is supplied with control oil X on a first face side 46 by means of a first line 48. A first seal 50, which seals the piston 42 against the housing 44, prevents the control oil X from passing along the casing surface of the piston 42 onto a second face side 52 of the piston 42. Arranged on the second face side 52 is a trip element 54, which acts on the delay contact 32. If the control oil pressure in the first line 48 is now increased, the piston 42 and with it the trip element 54 moves in the direction of the delay contact 32, which is brought from its open position into its closed position after a certain time. Here, the time necessary for this depends on the distance moved by the trip element until it has closed the delay contact 32, and on a pressure difference between the control oil pressure on the first face side 46 and a damping oil pressure in a damping volume 56 on the second face side 52. A defined cylinder section 58 of the piston 42 moves backwards or forwards in this damping volume 56 according to the prevailing pressure conditions, the cylinder section 58 having a larger diameter than the remaining part of the piston 42. In this way, a ring-shaped face-side surface area 60 remains on the side of the cylinder section 58, which faces away from the second face side 52, to which a second line 62 is connected. The other end of this line is connected to the damping volume 56 on the side of the second face side 52. In this way, the damping oil within the damping volume 56 can communicate via the second line 62 from the one face side of the cylinder section 58 with its other face side. An orifice 64 is arranged in the second line 62. The orifice 64 has the task of limiting the flow through the second line 62 in the event of a movement of the piston 42 in one or other direction, and in this way of building up a certain pressure. The size of the orifice diameter determines the speed and the pressure with which the damping volume passes from the one face side to the other face side of the cylinder section 58. In this way, the damping of the delay drive 30 can be adjusted in a particularly easy manner by an appropriate selection of the orifice. The delay drive shown is a realisation of the differential piston principle.

A further possible way of affecting the damping behaviour and the working speed of the piston 42 lies in changing the pressure of the damping oil pressure. For this purpose, a third line 66 is connected to the second line 62, the pressure in the damping oil P being either increased by means of the third line 66, which effects a slower working speed of the piston 42, or the pressure is decreased, which in turn results in a faster working speed of the piston 42. The damping behaviour or working speed of the piston 42 can also be changed in a particularly easy manner in this way.

An additional influence on the delay time, that is to say the time that the delay contact 32 needs to move from its open position into its closed position, consists in limiting or extending the piston movement in the direction of the delay contact 32. For this purpose, a rod 68 is connected to the first face side 46 of the piston 42 and in turn sealed against the housing 44 against an oil escape of control oil X by means of a second seal 70. An adjustment device 72, which is not shown in full detail however, acts on a free face surface of the rod 68. In a simple embodiment, this can be a manually adjustable adjustment device, such as a screw for example.

However, a drive or other adjustment measures are also to be provided here within the concept of the invention. In any case, the total stroke of the piston 42 and therefore the time between the start of the movement and making contact will be adjustable by means of the adjustment device 72.

The adjustment of the time until the delay contact 32 closes can be set particularly accurately by designing this as a bistable contact. For the contact, this means that it is automatically brought into its closed position at a pre-specified switching point determined by its design, and accordingly a defined switching point and the switching time associated with it can be predetermined particularly accurately. Accordingly, the stroke of the piston 42 can be matched to this switching point by means of the adjustment device.

A further exemplary use of a pre-defined damping volume 56 consists in the extensive independence of the temperature at which the system works.

The control oil X, which is required for supplying the delay drive, is comparatively little and can be taken from an existing control oil supply, for example that of the contact drive, without any problems. Also, the supply of damping oil can in principle be undertaken by an existing control oil supply. However, a separate damping volume can be provided with separate damping oil, e.g., when an adjustment facility by means of the damping oil pressure is not desired. In this way, namely by appropriate design of the orifice 64, it is possible to design the volume flow of damping oil, which moves via the orifice 64, so that the oil in the area of the orifice is in all cases in the turbulent flow range and, in this way, the pressure drop across the orifice can be calculated particularly accurately. If, in the case of a small volume flow via an orifice, the Reynolds numbers were too low, that is to say in the laminar flow range, the orifice diameter would have to be chosen to be correspondingly small so that such an arrangement would possibly result in technical problems, e.g., at low temperatures. In addition, when using small orifices, the effect of the manufacturing tolerances is comparatively large.

The delay drive 30 shown in this figure has a so-called double differential piston as the piston 42. With this, the active area of the piston is given by the difference of two pressure-effective face surfaces of the cylindrical piston 42. In this way, the required damping volume 56 can be made comparatively small.

A further possible way of adjusting the delay time until the delay contact closes consists in the delay contact first executing a so-called idle stroke. In the idle stroke, the piston 42 is moved backwards and forwards once, but only in such a way that the delay contact 32 does not close. As a result of the time required for the idle stroke, the speed allowed for the piston is increased overall and the effects on the switching time of manufacturing tolerances of the parts of the delay contact or of the delay drive are reduced.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Contact drive arrangement for the movement of at least one contact in high-voltage switchgear systems having a contact drive and having an auxiliary switch, which has at least two auxiliary contacts, the contact drive working together with the at least one contact and with a first auxiliary contact, wherein a delay drive is connected functionally in parallel with the contact drive, wherein the delay drive works together with a second auxiliary contact, wherein the first and second auxiliary contact are electrically connected in series, wherein the delay drive has a damping element, and wherein by means of the damping element the time for a switching operation is extended in comparison with the time for a switching operation with the contact drive.

2. Contact drive arrangement according to claim 1, wherein the contact drive is a hydromechanical drive.

3. Contact drive arrangement according to claim 1, wherein the delay drive is an electrical or pneumatic drive.

4. Contact drive arrangement according to claim 1, wherein the delay drive is a hydraulic drive, in particular with a differential piston cylinder.

5. Contact drive arrangement according to claim 4, wherein the contact drive and the delay drive are separate components or are arranged in one component.

6. Contact drive arrangement according to claim 4, wherein the contact drive and the delay drive can be actuated with the same control pressure supply.

7. Contact drive arrangement according to claim 4, wherein the hydraulic damping element has a pre-specified quantity of a liquid damping medium in a pre-specified damping volume, said quantity being independent of the control medium, wherein an orifice divides the pre-specified volume, and wherein when activated the damping medium passes only via the orifice from one part to another part of the damping volume.

8. Contact drive arrangement according to claim 1, wherein the auxiliary contacts are bistable contacts.

9. Contact drive arrangement according to claim 1, wherein a delay time of the delay contact can be adjusted.

10. Contact drive arrangement according to claim 1, wherein the contact drive has a piston, which is designed as a differential piston.

11. Contact drive arrangement according to claim 2, wherein the delay drive is an electrical or pneumatic drive.

12. Contact drive arrangement according to claim 2, wherein the delay drive is a hydraulic drive, in particular with a differential piston cylinder.

13. Contact drive arrangement according to claim 5, wherein the contact drive and the delay drive can be actuated with the same control pressure supply.

14. Contact drive arrangement according to claim 6, wherein the hydraulic damping element has a pre-specified quantity of a liquid damping medium in a pre-specified damping volume, said quantity being independent of the control medium, wherein an orifice divides the pre-specified volume, and wherein when activated the damping medium passes only via the orifice from one part to another part of the damping volume.

15. Contact drive arrangement according to claim 7, wherein the auxiliary contacts are bistable contacts.

16. Contact drive arrangement according to claim 8, wherein a delay time of the delay contact can be adjusted.

17. Contact drive arrangement according to claim 9, wherein the contact drive has a piston, which is designed as a differential piston.

18. A method of arrangement for movement of at least one contact in high-voltage switchgear systems having a contact drive and having an auxiliary switch, which has at least two auxiliary contacts, the contact drive working together with the at least one contact and with a first auxiliary contact, the method comprising:

connecting a delay drive functionally in parallel with the contact drive, the delay drive having a damping element, wherein the delay drive works together with a second auxiliary contact;

electrically connecting the first and second auxiliary contacts in series; and extending the time for a switching operation in comparison with the time for a switching operation with the contact drive, by using the damping element.

* * * * *